US005152337A

United States Patent [19]

Kawakatsu et al.

[11] Patent Number: 5,152,337

[45] Date of Patent: Oct. 6, 1992

[54] STACK TYPE EVAPORATOR

[75] Inventors: Mikihito Kawakatsu; Kenji Sakamoto; Hidenori Esaki, all of Utsunomiyashi; Yuji Yamamoto; Nobuyuki Okuda, both of Oyamashi, all of Japan

[73] Assignees: Honda Giken Kogyo; Showa Aluminum, both of Japan

[21] Appl. No.: 759,644

[22] Filed: Sep. 12, 1991

Related U.S. Application Data

[63] Continuation of Ser. No. 569,569, Aug. 20, 1990, abandoned.

[30] Foreign Application Priority Data

Aug. 30, 1989 [JP] Japan ..... 1-223685
Jan. 18, 1990 [JP] Japan ..... 2-104291

[51] Int. Cl.[5] ..... F28D 1/03

[52] U.S. Cl. ..... 165/153; 62/288; 165/111; 165/170; 165/913

[58] Field of Search ..... 62/515, 524, 526, 288, 62/290; 165/152, 153, 170, 111, 913

[56] References Cited

U.S. PATENT DOCUMENTS 1,775,819 9/1930 Fischer et al. ..... 165/170
2,690,653 10/1954 Kleist ..... 165/170 X
4,081,025 3/1978 Donaldson ..... 165/153 X
4,274,482 6/1981 Sonoda ..... 165/153
4,621,685 11/1986 Nozawa ..... 165/111
4,805,693 2/1989 Flessate ..... 165/153
4,815,532 3/1989 Sasaki et al. ..... 165/152
4,915,163 4/1990 Matsunaga et al. ..... 165/153

FOREIGN PATENT DOCUMENTS 5332375 8/1978 Japan .

*Primary Examiner*—William E. Tapolcai
*Attorney, Agent, or Firm*—Tilton, Fallon, Lungmus & Chestnut

[57] ABSTRACT

A stack type evaporator according to the invention comprises a plurality of plate-shaped tubular elements stacked in a direction of their width with a fin member interposed between two of such tubular elements which have inlet header portions at their ends and outlet header portions at their further ends so that coolant can flow straight within said tubular elements, a pair of dish-shaped core plates which constitute each tubular element having inner surfaces provided with ribs arranged at regular intervals in a direction of coolant flow, wherein an end surface of each rib protruding from one core plate is alternately bonded to a flat body of the other core plate whereby the coolant paths within each tubular element are formed parallel with each other and straight from the inlet header portion toward the outlet header portion.

12 Claims, 7 Drawing Sheets

STACK TYPE EVAPORATOR

This application is a continuation of application Ser. No. 07/569,569, filed Aug. 20, 1990, now abandoned.

BACKGROUND OF THE INVENTION

1. Field of the Invention

The present invention relates to a stack type evaporator for use in the car cooling system or the like, and more particularly to a stack type evaporator which comprises a plurality of plate-shaped tubular elements each having inner paths for coolant, wherein a plurality of air paths are defined through and by a fin member interposed between one tubular element and the next.

2. Description of the Prior Art

In general stack type evaporators for the uses mentioned above comprise tubular elements whose inner paths for coolant are in fluid communication with each other in such a state that a coolant circuit is formed between an inlet and an outlet of the coolant. A mist of the coolant enters the inlet and flows through the circuit so that heat exchange takes place between the coolant and the air passing through the air paths The coolant is thus gradually evaporated to become a gas which then flows out of the evaporator though the outlet.

FIG. 12 shows one of the known tubular elements (such as those disclosed in Japanese Utility Model Publication Sho. 53-32375) which has one end portion formed with a delivery header 10*a* and a return header 10*b*. A coolant stream circuit is formed such that coolant flows through the delivery header 10*a* into the inside of said tubular member, advances toward the other end portion thereof where it makes a U-turn, and then flows back to the return header 10*b*. Such a coolant stream within the circuit is made turbulent by the existence of many protruding inner ribs 70 possessed by each of dish-shaped core plates 60 which are secured to each other at their peripheries so as to form a space for the coolant circuit therebetween, the ribs 70 being disposed within the space. Said ribs 70 are oblique with respect to the flow direction of coolant stream, and as shown by rigid lines and phantom lines in FIG. 12, each rib 70 of one core plate 60 and each corresponding rib 70 of the other core plate firmly coupled with the one core plate intersect one another. However, the U-turn of the coolant stream within said circuit of the tubular element is likely to cause a "channel" or uneven flow of coolant in the circuit, thereby bringing about a substantial decrease in the effective heat transfer surface.

It is further to be noted that the mutually intersecting ribs 70 disposed oblique to the direction of coolant flow are disadvantageous in that pressure loss of coolant increases unfavorably in the tubular elements near an outlet port of the evaporator, in spite of lowered efficiency of heat transfer due to the increasing ratio of gas in the coolant which is getting near the outlet. Such a disadvantage depreciates the value of an expected advantage, that is an improved heat transfer efficiency, which will be obtained owing to violent turbulence of coolant in the tubular elements disposed near an inlet port of the evaporator.

OBJECTS AND SUMMARY OF THE INVENTION

Therefore, an object of the invention which was made in view of the problems in the known evaporators is to provide a stack type evaporator which is low in its pressure loss of coolant but high in its heat transfer efficiency.

Another object of the invention is to provide a stack type evaporator which is of an improved drainage of condensed water appearing in or entering air paths defined between two neighboring tubular elements or between an outermost tubular element and a side plate adjacent thereto, whereby the so-called "water-drop-flying" phenomenon is avoided.

A further object of the invention is to provide a stack type evaporator which is higher in rigidity, lighter in weight and improved in pressure resistance.

The other objects and advantages of the invention will become apparent from the following detailed description and the accompanying drawings of the preferred embodiments which are given merely by way of example, whilst the scope of the present invention is not restricted thereto but includes various modifications of design choice which would be derived from entire description given herein.

The stack type evaporator in the invention comprises a delivery or inlet header at one end portion thereof and a return or outlet header at the other end portion in such a state that coolant may flow straight within each tubular element, which tubular elements comprise a plurality of ribs formed parallel with a flow direction of the coolant so that an overall pressure loss of the evaporator is decreased and heat transfer is effected uniform within a region defined between the inlet and outlet headers.

In more detail, the stack type evaporator according to the invention comprises a plurality of plate-shaped tubular elements of a predetermined thickness, the tubular elements being stacked side by side in a direction of the thickness with a fin member interposed between two of such tubular elements, and being composed respectively of a pair of dish-shaped core plates which are provided with a plurality of ribs protruding from a flat body and are fixed to each other at their peripheries so as to form coolant paths, the pair of core plates facing each other with their ribs arranged inwardly, each tubular element further comprising an inlet header portion disposed at an end and an outlet header portion disposed at another end, wherein the ribs of each core plate extend parallel with a flow direction of the coolant and are arranged at regular intervals of distance to form a row in a direction perpendicular to the flow direction, and wherein each rib protruding from one of the paired core plates is disposed intermediate between two ribs protruding from the other core plate in said pair so that end surfaces of the ribs of one core plate are alternately bonded to the flat body of the other core plate in said pair whereby the coolant paths are formed parallel with each other and straight from the inlet header portion toward the outlet header portion.

The coolant which flows through the tubular elements each provided with the inlet header portion at one end and with the outlet header portion at the other end need not to make any U-turn. Thus, any uneven flow of the coolant does not occur in the evaporator of the invention, thereby eliminating the problem that the effective heat transfer surface is decreased and the pressure loss is increased due to the U-turn of coolant in the known apparatuses.

The coolant can flow through the coolant circuit of evaporator smoothly without being disturbed by the ribs which are formed parallel with the flow direction so that heat transfer takes place uniform throughout said circuit extending from an inlet pipe to an outlet pipe for the coolant, with a decreased pressure loss and with an improved overall efficiency or heat transfer.

Further, such an alternate position of the ribs of the coupled core plates as employed in the invention wherein the end surface of each rib of one core plate bears against the facing flat body of the other core plate will not only improve heat transfer efficiency but also will secure the core plates more rigidly to each other, thereby improving the pressure resistance of the evaporator. In order to improve heat exchange efficiency, it is desirable to employ a smaller "equivalent diameter" for the coolant paths, the equivalent diameter being such a value as obtained by dividing by an internal periphery length of coolant path a product of cross-sectional area thereof multiplied by "4". According to the invention, the equivalent diameter can be made sufficiently small though a rib pitch ( i.e., distance between two adjacent ribs ) of the core plates is high. In other words, such a high rib pitch in the invention does not significantly reduce the equivalent diameter of coolant paths, but makes easier the manufacture of the core plates in the invention. It is also advantageous that the outer flat surfaces of the core plates are so broad that the area of contact with the corrugated fins is increased to further improve the heat exchange efficiency.

An amount of water which is condensed in the air flow passages defined between adjacent tubular elements can smoothly flow down along draining recesses defined between the ribs. Therefore, the so-called "water-drop-flying" phenomenon is prevented from taking place in the evaporator provided in the invention. In an embodiment wherein a side plate is attached to the outermost fin member, inner grooves or channels formed thereon to extend in a vertical direction may help the condensed water flow down smoothly to avoid the flying of water drops even if a significant amount of water is condensed or flows in between the outermost tubular element and the side plate.

BRIEF DESCRIPTION OF THE DRAWINGS

The present invention will become more apparent from embodiments described referring to the accompanying drawings: in which

FIGS. 5 to 11 illustrate a second embodiment, wherein

FIG. 5 is a perspective view showing a side plate, corrugated fin members and tubular elements, in their separated state;

FIG. 6 is a front elevation of an evaporator;

FIG. 7 is a plan view of the evaporator;

FIG. 8 is a side elevation of the tubular element;

FIG. 9 is also a side elevation of a core plate;

FIG. 10 is a cross section taken along a line 10—10 in FIG. 6;

FIG. 11 is an enlarged partial front elevation of the evaporator; and

DETAILED DESCRIPTION OF THE PREFERRED EMBODIMENTS

Embodiments of the invention which are applied to stack type evaporators made of aluminum or its alloys for use in the car cooling system will now be described in detail.

FIGS. 1 to 4 illustrate a stack type evaporator manufactured according to a first embodiment of the invention.

This evaporator comprises a plurality of plate-shaped tubular elements 1 which are disposed upright and stacked side by side in a horizontal direction. The evaporator also comprises corrugated fin members 2, most of them being interposed respectively between two adjacent tubular elements 1, and remaining one of them disposed outside of the outermost tubular element. Each corrugated fin member 2 is fixed integral with the tubular elements.

Each of the tubular elements 1 is, as shown in FIGS. 1 to 4, provided with upper and lower header portions 1*a* and 1*b* (which function either as an inlet or as an outlet header portion, as will become apparent from the description given hereinafter) which are bulky and disposed respectively at opposite ends in a longitudinal direction of the element. Coolant paths 1*c* extending longitudinally of the element 1 are formed intermediate between and in fluid connection with the header portions 1*a* and 1*b*, the coolant paths 1*c* as a whole thereby assuming a flat path for coolant.

Figure 4:
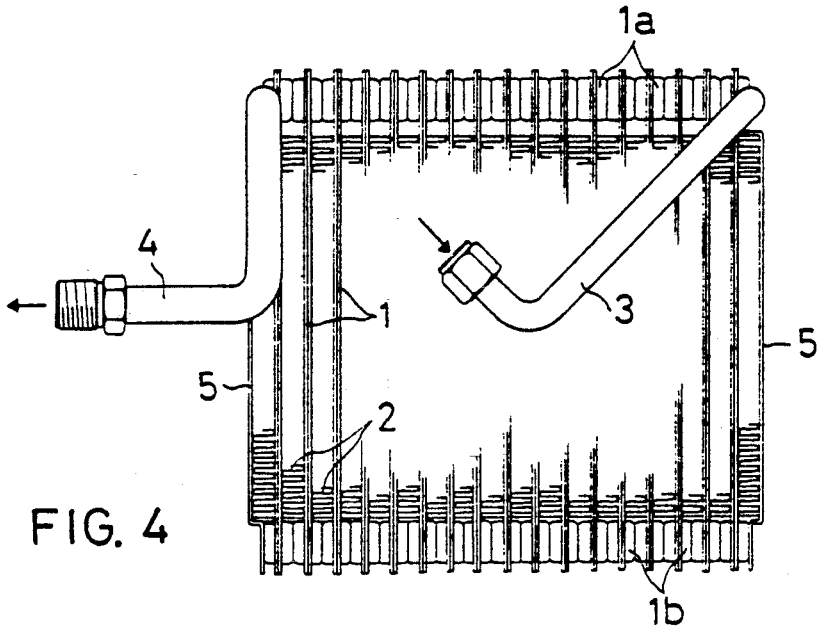
FIG. 4 is a front elevation showing an assembled state of an evaporator.

The adjacent tubular elements 1 are tightly combined one another at their header portions 1*a* and 1*b* which are in close contact and in fluid connection with each other owing to coolant-flowing openings 1*d*. As shown in FIG. 4, the upper header portion 1*a* of the right-hand (in the drawings) outermost tubular element 1 is connected to a coolant inlet pipe 3, on the other hand the upper header portion 1*a* of the left-hand (in the drawings) outermost tubular element 1 is connected to a coolant outlet pipe 4. Small blind plates (not shown) are mounted between the upper header portions 1*a* of the second and third tubular elements near the coolant inlet, between those of the eighth and ninth ones, and between the fourteenth and fifteenth ones near the coolant outlet so as to close the coolantflowing openings 1*d*. Similarly, the small blind plates (not shown) are also interposed between the lower header portions 1*b* of the fifth and sixth tubular elements, and between those of the eleventh and twelfth ones so as to close the coolant-flowing openings 1*d*. Such blind plates cause the coolant flowing into the evaporator through the inlet pipe 3 to advance in zigzag patterns changing its flow direction at every boundary between adjacent groups of the tubular elements. Heat exchange is effected between the coolant flowing in this way and air streams passing through air paths which are formed between the adjacent tubular elements and through the fin members 2, before the coolant leaves the evaporator through the outlet pipe 4. The reference numeral 5 in FIG. 4 denotes a side plate disposed outside of the outermost corrugated fin member.

The tubular elements 1 are each made by arranging two dish-shaped core plates 6 into an inside-to-inside relation and by subsequently soldering them at their peripheries 6*a* to be integral with each other. The core plates 6 are manu- factured by the pressing of any appropriate metal, preferably by the pressing of a brazing sheet. The brazing sheet comprises an aluminum-based alloy core sheet having its front and back surfaces covered with a brazing metal which is applied by the cladding technique. End portions of each core plate 6 protrude outwardly to form expanded portions 9. A coolant-flowing opening 1*d* is formed through a ridge of each expanded portion, in a transverse direction of the core plate extends. Protruding from a semicircular edge of the elliptical opening 1*d* is a flange 9*a*.

Formed on inner surface of the core plate 6 are ribs 7 which contribute to the improvement of heat transfer efficiency in the evaporator according to the embodiment. The ribs 7 run parallel with a flow direction of coolant, i.e., longitudinally of the core plate and extend almost all over the entire length thereof. Said ribs 7 are located at regular intervals in the transverse direction although they are slightly offset as a whole toward one side edge of said core plate 6.

Figure 1:
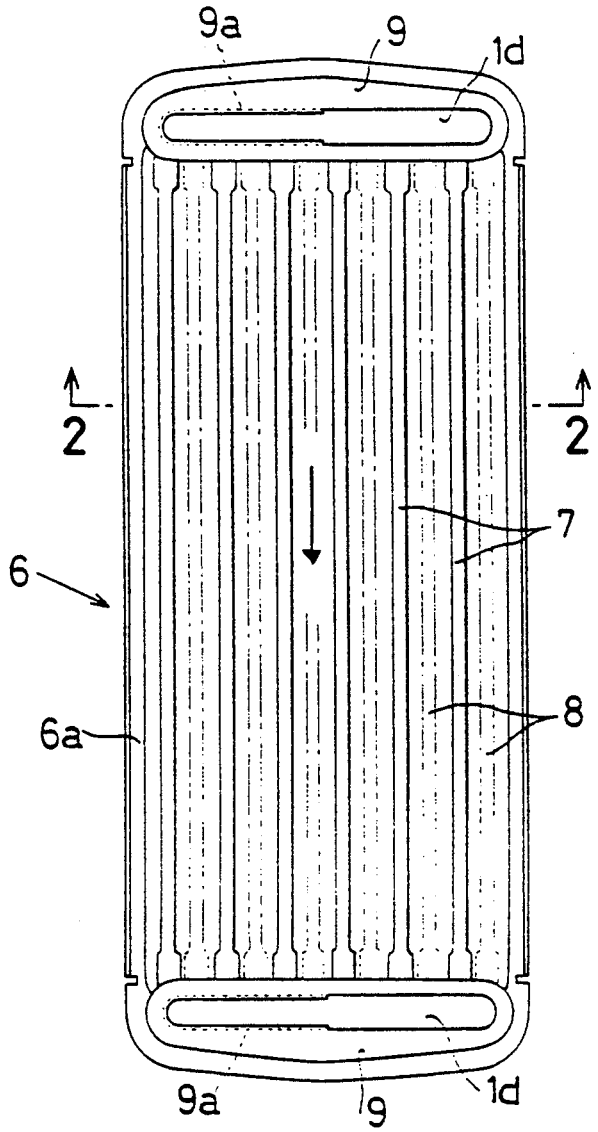
FIG. 1 is a side elevation of a core plate, seen from the side of coolant paths, in a first embodiment.
Figure 2:
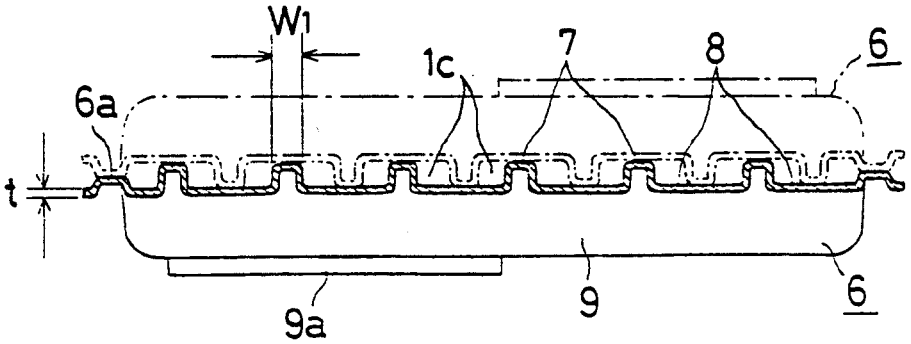
FIG. 2 is an enlarged cross section taken along a line 2—2 in FIG. 1.
Figure 3:
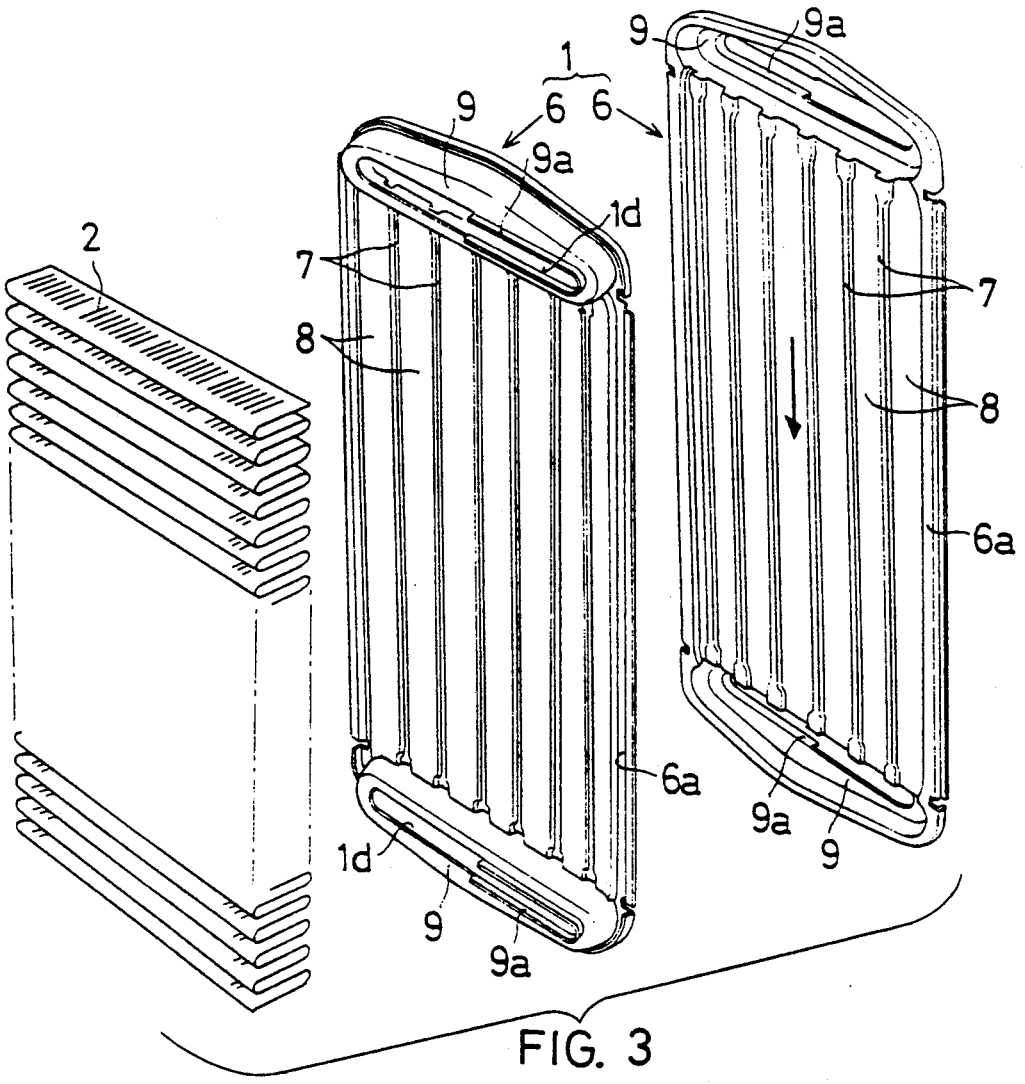
FIG. 3 is a perspective view showing two core plates constituting one tubular element as well as a corrugated fin member which are in a separated state.

Two core plates 6 each having the ribs 7 are brought into close contact so as to be soldered at their peripheries 6*a*. As seen in FIGS. 1 and 2, the rib 7 of one core plate 6 shown by rigid lines and that of the other core plate shown by phantom lines alternate with each other. End surfaces of the ribs 7 of one core plate 6 tightly engage with and are soldered to a flat body 8 between two adjacent ribs 7 of the other core plate whereby the plurality of coolant paths 1*c* are defined straight from the delivery header 1*a* to the return header 1*b* within tubular element 1.

Such straight coolant paths 1*c* enhance smoothness of coolant flow by preventing uneven flow or violent agitation of the coolant from taking place in the tubular element 1. Further, the coolant flows so uniformly through all the paths that heat transfer is efficiently effected improving the heat transfer capacity of the evaporator.

In addition, any excessively high accuracy is not required in manufacturing the evaporator in the invention since the end surfaces of the ribs 7 in one core plate need not be strictly aligned with each other but may merely be placed on and soldered to the relatively wide flat body 8 of the other core plate 6, in a state such that as already described the ribs of two core plates alternate in a direction perpendicular to the flow direction of coolant. This structure is also advantageous in that the two core plates 6 can be easily and securedly soldered to enhance the mechanical strength and pressure resistance of the tubular elements 1 in the evaporator. Furthermore, such a structure is also effective to increase the heat transfer surface and to raise the heat transfer efficiency.

Another important feature of the first embodiment resides in the shape of the ribs 7 which are wider at their ends so that the coolant paths 1*c* are constricted at their portions near the inlet and outlet. This enables the coolant to flow more uniform between the paths, preventing any inadvertent decrease in the effective surface of heat transfer In order to make the coolant path cross section as large as possible, it is preferable to design the width W1 of ribs 7 so as to fall within a range from two to four times the thickness "t" of the plate, as illustrated in FIG. 2.

For a higher heat exchange efficiency, an equivalent diameter of the coolant paths 1*c* is to be designed as small as possible. Each coolant path 1*c* in this embodiment is designed to be 2.1 mm wide and 1.9 mm high, thus to be about 1.99 mm in equivalent diameter, as given by a calculation: $1.99=4\times(2.1\times1.9)/[2\times(2.1+1.9)]$.

A second embodiment of the invention will now be described referring to FIGS. 5 to 11.

Although the fundamental features of an evaporator in the second embodiment are the same as those in the first embodiment, there are some minor differences for instance in the header portions of tubular elements, in the structure of side plates or other members.

The evaporator in the second embodiment is also provided with the tubular elements 101 which have at their longitudinal ends an upper header portion 101*a* and a lower header portion 101*b* of a bulky shape. The plate-like tubular elements 101 are disposed upright and stacked side by side with a corrugated fin member 102 interposed between two of such elements. One corrugated fin member 102 is located outside of the outermost tubular element 101 and is covered with a side plate 105.

Fluid communication passages formed through coolant-flowing openings 101*d* is closed between the upper header portions 101*a* of the fifth and sixth tubular elements near a coolant inlet, and between those of the fourteenth and fifteenth ones near a coolant outlet. Similarly, said passages through the openings 101*d* is closed between the lower header portions 101*b* of the tenth and eleventh tubular elements. Such a local closing of the passages causes the coolant flowing into the evaporator through an inlet pipe 103 via an inlet header 103*a* to advance zigzag changing its flow direction at every boundary between adjacent groups of the tubular elements, before it flows out of the evaporator through an outlet pipe 104 via an outlet header 104*a*.

The tubular element 101 are constructed, as is in the first embodiment, by facing two dish-like core plates 106 to each other and by soldering them integral with each other. Ribs 107 protruding from the inner surfaces of the core plates 106 and arranged at regular intervals longitudinally of said plates form coolant paths 101*c* which extend straight within each tubular element 101, from an upper header portion 101*a* to a lower header portion 101*b*.

Figure 5:
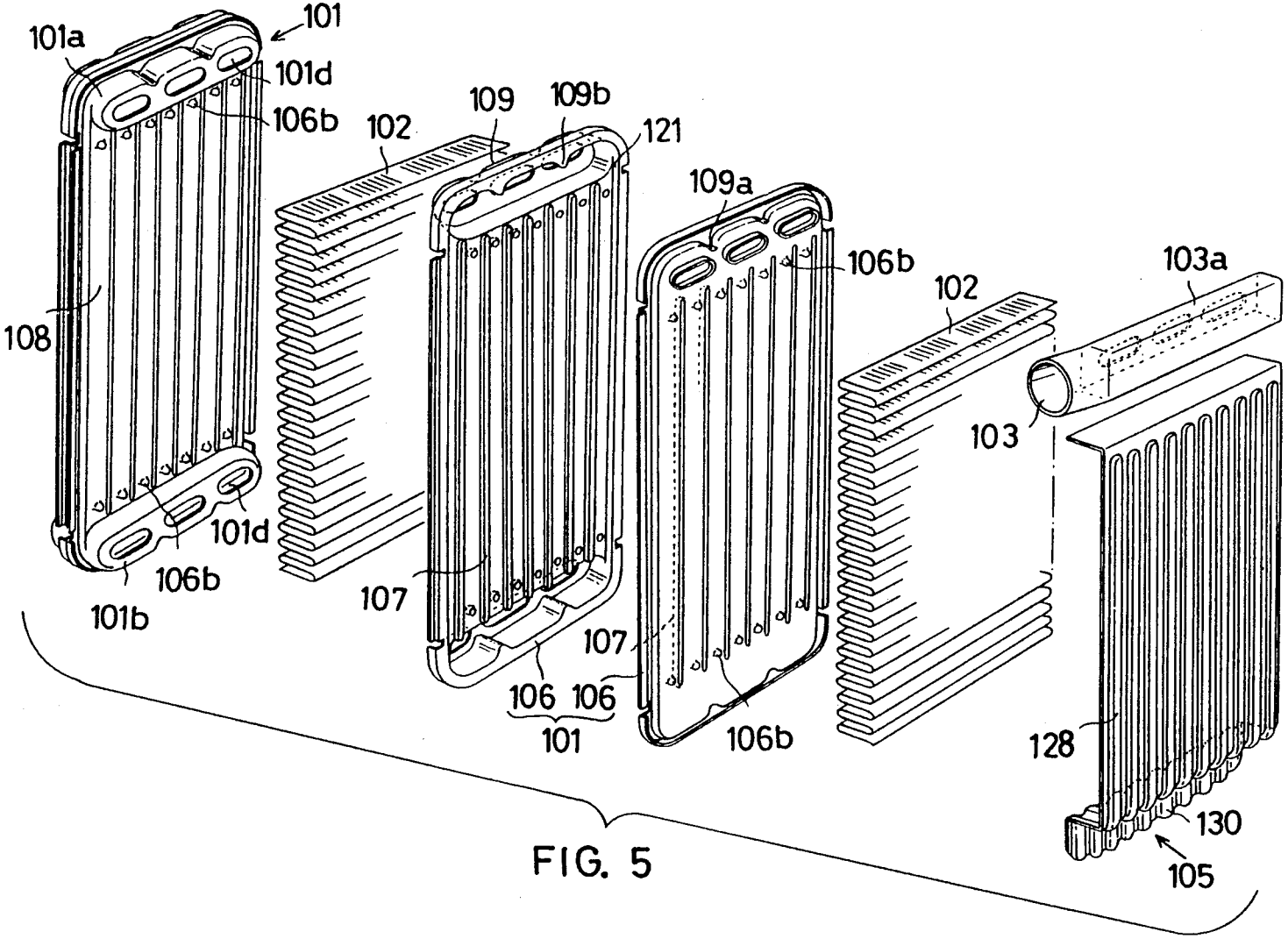
Figure 7:
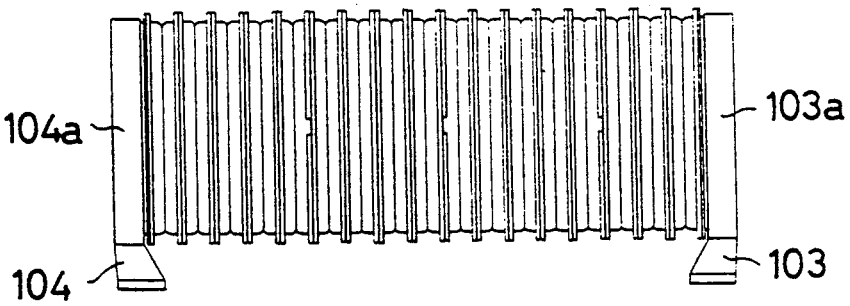
Figure 8:
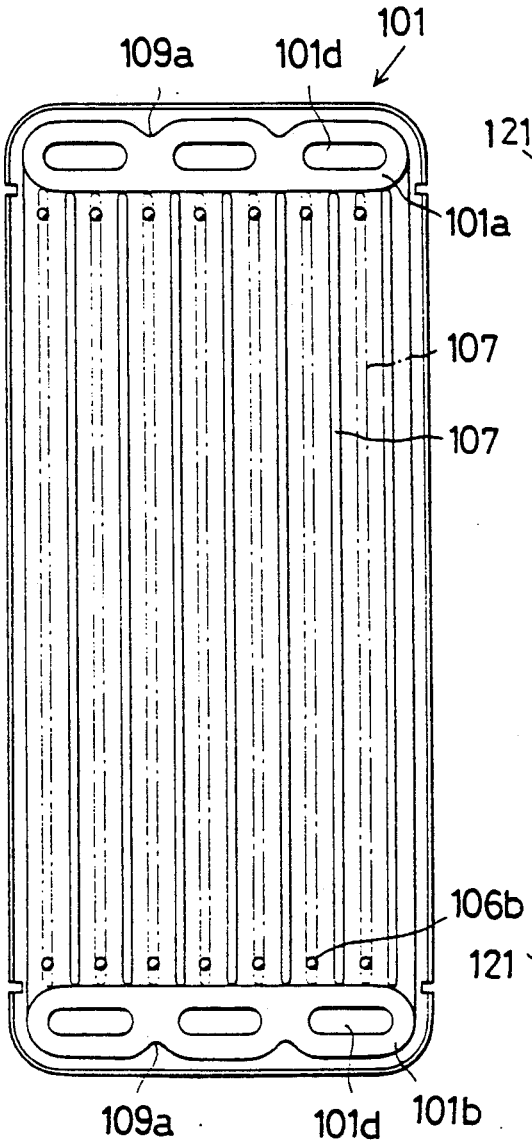
Figure 9:
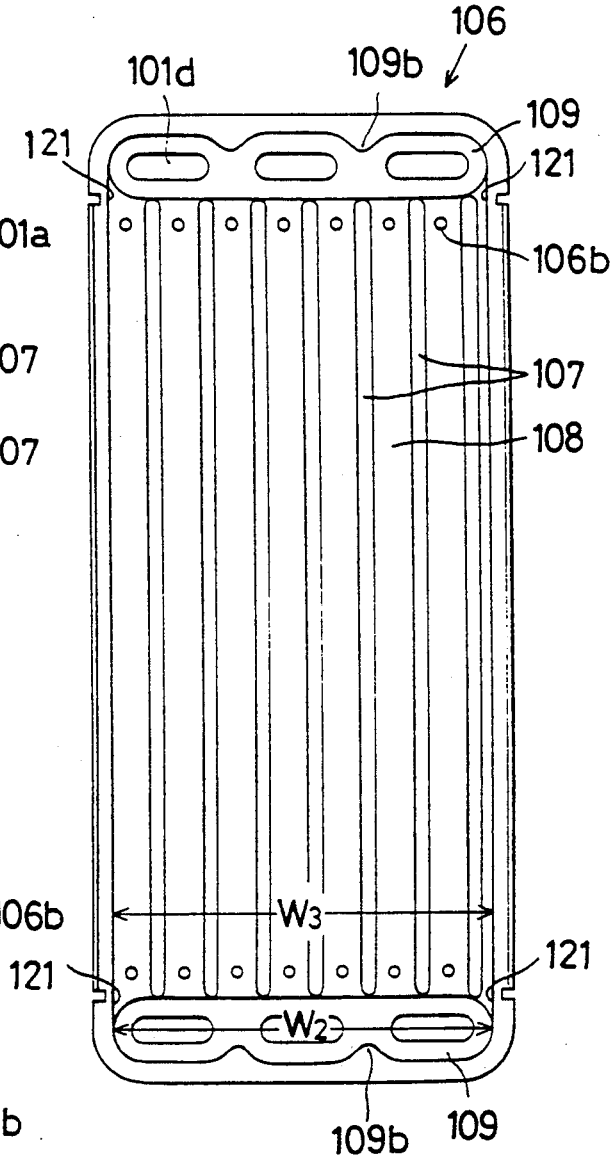
Figure 10:
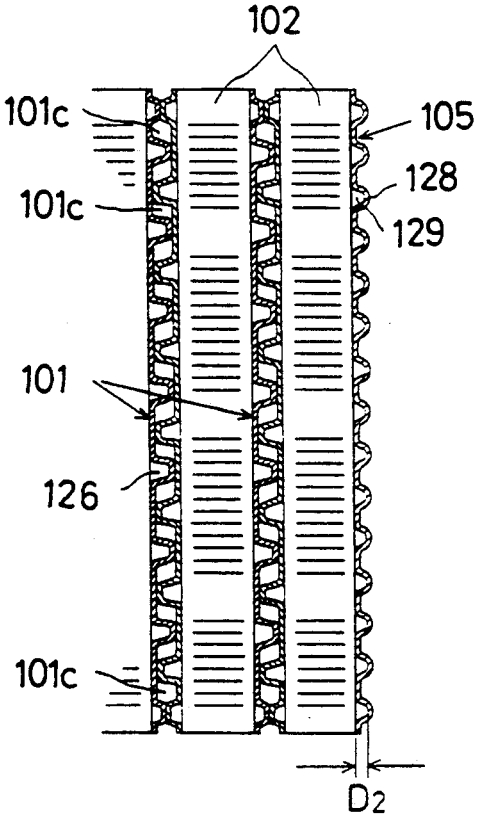

Upper and lower expanded portions 109 of the core plates 106 are of an elliptical shape, as shown in FIGS. 5, 8 and 9, which allows three rows of coolant-flowing openings 101*d* to be formed therethrough. There are formed recesses 109*a* above and between the coolant-flowing openings 101*d* of the upper expanded portions 109, and also below and between the said opening 101*d* of the lower expanded portions 109. Lugs 109*b* which are formed corresponding to the recesses 109*a* are engaged therewith to provide additional soldered surfaces which will improve the pressure resistance of said upper and lower header portions 101*a* and 101*b* so as to withstand well the pressure of coolant.

Figure 11:
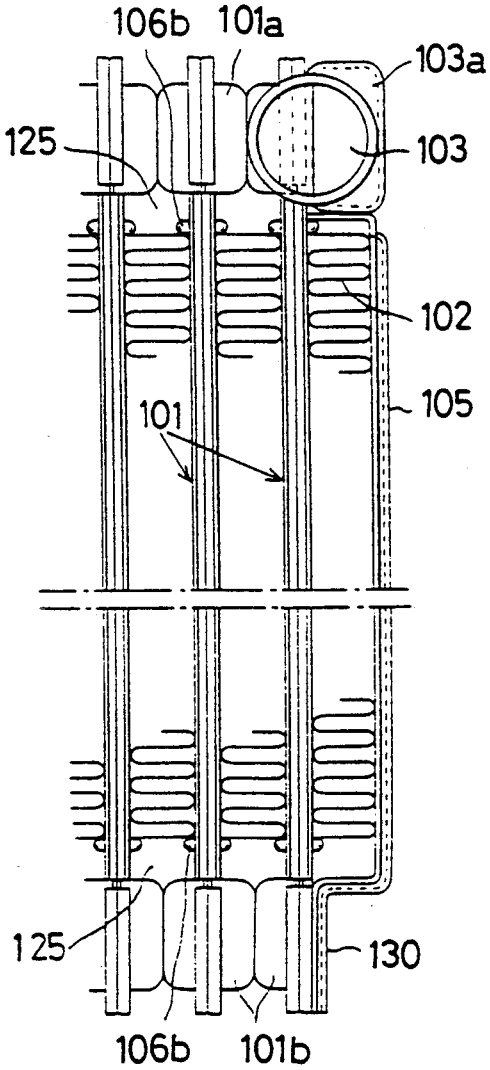
Figure 12:
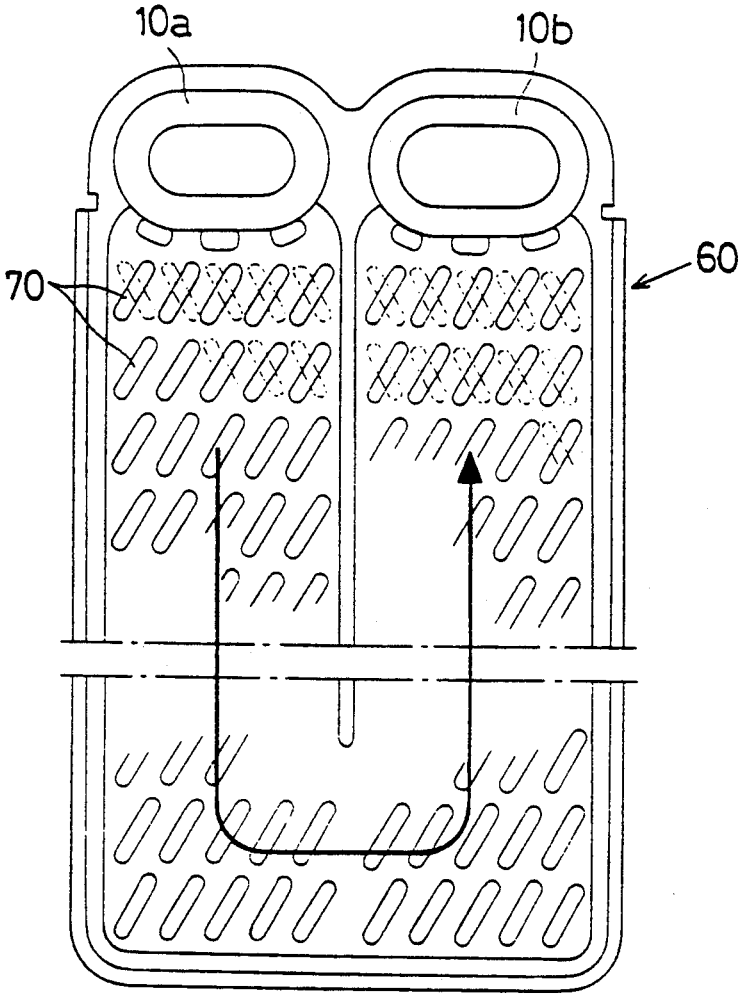
FIG. 12 (Prior Art)
FIG. 12 is a side elevation of a core plate, seen from the side of coolant paths, in the known apparatus.

Protrusions 106*b* on the surfaces of said core plates 106 are used to place in position the corrugated fin members 102. Said protrusions 106*b* are located adjacent to but more inwardly than the expanded portions 109, and are arranged between the ribs 107 as well as outside of the outermost rib 107 in such a state as forming rows. The upper and lower rows of the protrusions 106*b* support as shown in FIG. 11 the upper and lower ends of the corrugated fin members 102, respectively, when the tubular elements 101 and the fin members 102 are temporarily assembled to alternate with each other before they are soldered. Thus, there will be provided gaps of a predetermined distance between the top surfaces of the fin members and the upper header portions 101*a*, as well as between the bottom surfaces of said fin members and the lower header portions 101*b*. Such gaps will function as draining gaps 125 after all the integral parts of the evaporator are bonded to each other in one and single operation by, for example, the soldering method.

As is shown in FIG. 9, the inner width of the expanded portions 109 is preferably made substantially the same as that of a flat pipe portion 108. Side walls 121 which cover the portions 108 and 109 continuously extend straight from the inside of said flat pipe portion 108 towards the upper and lower header portions 101*a* and 101*b* whereby all of the coolant paths 101*c* including the outermost one are straight fluid connection with said header portions 101*a* and 101*b*.

Figure 6:
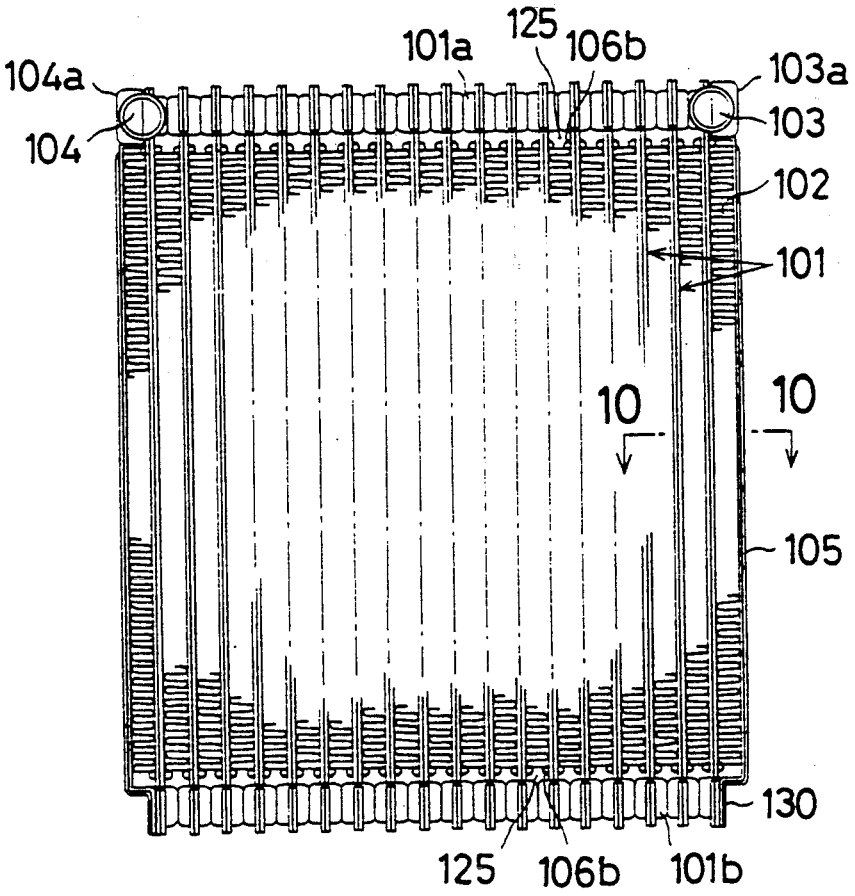

As will be seen in FIGS. 5 and 6, the side plates 105 have a plurality of inner channels 128 which are formed by, for instance, the pressing of metal sheet to extend vertically and parallel with each other. Such inner channels 128 provide vertical drain ducts 129 between the side plate 105 and the corrugated fin member 102.

In operation of the abovedescribed evaporator, heat transfer takes place between the stream of coolant and the stream of air, the former entering the evaporator through the inlet pipe 103 to flow through said evaporator and leave it through the outlet pipe 104, while the latter is flowing through air paths defined in the corrugated fin members 102 disposed between two tubular elements 101 or between one tubular element 101 and the side plate 105. As a result of such heat transfer, the heat of air stream is absorbed by the evaporator so that a considerable amount of condensed water will be produced in the air paths between two tubular elements 101 or between the outermost tubular element 101 and the side plate 105, or such condensed water will enter said air paths.

The amount of condensed water in the air paths between the two tubular elements 101 will flow downwards through drain ducts 126 (shown in FIG. 10) which are defined between the outer surface of tubular elements and the corrugated fin members 102 due to recesses formed by the ribs 107. Then, the condensed water will be discharged to the outside through the draining gaps 125 defined between the outer bottom surface and the lower header portions 101*b*.

On the other hand, another amount of condensed water in the air paths between the outermost tubular element 101 and the side plate 105 will flow downwards likewise through drain ducts 126 defined by the ribs 107 between the outermost tubular element 101 and the corrugated fin member 102. In addition, said another amount of condensed water will also flow downwards through the drain ducts 129 formed between the side plate 105 and the corrugated fin member 102 due to the inner channels 128. Thus, drainage is improved for those air paths in a region mentioned here whereby the water-drop-flying is prevented which has been inevitably caused by the air flow through the known evaporators.

Depth "D2" of the inner channels 128 is designed such that the amount of condensed water can smoothly flow, and may preferably be set at 0.5 mm or more.

The inner channels 128 are formed by corrugation of said side plates 105 so that rigidity thereof is increased. Therefore, load can be uniformly imparted to the entire width of a temporary assembly consisting of the side plates 105 and pairs of the alternating tubular elements 101 and fin members 102, said pairs being interposed between the side plates 105 in "banding" state before the soldering process.

The increased rigidity can make thinner the side plates 105 to about 0.5 mm, whose thickness has been about 1.6 mm in the known evaporators.

As shown in FIGS. 5, 6 and 11, the lowermost portions of the side plates 105 are pressed to be header supporting tongues 130 which abut the end surfaces of the lower header portions 101*b*. The inner channels 128 extend across the tongues 130, continuously from the main portions of said side plates. This structure of the end plates not only ensures the drainage of condensed water but also increases the mechanical strength at the outer surfaces of lower header portions 101*b* of the outermost tubular elements 101, to which portions 101*b* neither the header 103*a* nor the header 103*b* is attached after all of the evaporator parts are made rigidly integral with each other.

What is claimed is:

1. A stack type evaporator comprising a plurality of plate-shaped tubular elements of a predetermined thickness, said tubular elements being stacked side by side in a direction of the thickness with a fin member interposed between two of said tubular elements, and being composed respectively of a pair of dish-shaped core plates which are provided with a plurality of ribs protruding from a flat body and are fixed to each other at their peripheries so as to form coolant paths, a plurality of open-top groove-like drain ducts extending from one end of each said tubular elements toward the other end and formed on each side of said tubular elements, whereby water condensed on said side surface of each said tubular element flows through said drain ducts to be discharged at said other end to thereby effectively prevent any water-drop-flying action from occurring, said pair of core plates facing each other with said ribs arranged inwardly, each said tubular element further comprising an inlet header portion disposed at an end and an outlet header portion disposed at another end, wherein said ribs of each said core plate extend parallel with a flow direction of the coolant and are arranged at regular intervals of distance to form a row in a direction perpendicular to the flow direction, and wherein each said rib protruding from one of the pair of said core plates is disposed intermediate between the two said ribs protruding from the other core plate of said pair so that end surfaces of said ribs of said one core plate are alternately bonded to said flat body of said other core plate of said pair, said ribs extending straight from said inlet header portion towards said outlet header portion, said ribs having outer surfaces formed on said side surfaces of said tubular elements, said rib outer surfaces respectively forming said plurality of open-top groove-like drain ducts, whereby the coolant paths are formed parallel with each other.

2. A stack type evaporator according to claim 1, wherein said tubular elements are disposed vertical and stacked side by side in a horizontal direction.

3. A stack type evaporator according to claim 1, wherein said core plates are formed by pressing a brazing sheet which comprises a core material of aluminum alloy having front and back surfaces covered with a soldering agent which is applied by the cladding method.

4. A stack type evaporator according to claim 1, wherein said core plates are formed at their ends with elliptical expanded portions having ridge portions through which a row of coolant flowing openings are formed.

5. A stack type evaporator according to claim 4, wherein said expanded portion of said one core plate is formed at its outer surfaces with recesses which are disposed between said coolant-flowing openings, said recesses mating and bonded to corresponding lugs of said other core plate.

6. A stack type evaporator according to claim 1, wherein said core plates comprise protrusions adapted to determine the positions of upper and lower end surfaces of said corrugated fin members.

7. A stack type evaporator according to claim 1, wherein said core plates are formed to have substantially the same inner width of said expanded portions as an inner width of said flat body portions whereby all of said coolant paths including an outermost coolant path extend straight into fluid communication with the inside of said header portions.

8. A stack type evaporator according to claim 1, wherein said ribs are wider at their ends than at their intermediate portions whereby said coolant paths are narrowed down near said inlet and outlet header portions.

9. A stack type evaporator according to claim 1, whereby said ribs are of a width falling within a range of two times to four times a thickness of said core plates.

10. A stack type evaporator according to claim 1, wherein said fin members is disposed on the outside of each outermost said tubular element, and a side plate having inner vertical channels is disposed on the outside of said one fin member, whereby said drain ducts are provided along said inner channels between said side plate and said one fin member.

11. A stack type evaporator according to claim 10 wherein said inner channels run parallel with each other.

12. A stack type evaporator according to claim 10 or 11, wherein said inner channels have a depth of 0.5 mm or more.

* * * * *